United States Patent [19]

Grant

[11] Patent Number: 4,993,911

[45] Date of Patent: Feb. 19, 1991

[54] MOBILE CRANE

[75] Inventor: Robert K. Grant, Mullins, S.C.

[73] Assignee: Grant Wrecker Equipment, Inc., Marion, S.C.

[21] Appl. No.: 390,167

[22] Filed: Aug. 7, 1989

[51] Int. Cl.[5] ..... B66C 23/74

[52] U.S. Cl. ..... 414/563; 414/569; 212/261

[58] Field of Search ..... 414/560, 563, 569, 639, 414/640, 641, 642; 212/183, 185, 261, 264; 280/402

[56] References Cited

U.S. PATENT DOCUMENTS

| | | | |
|---|---|---|---|
| 2,290,384 | 7/1942 | Rowe | 212/264 X |
| 2,822,931 | 2/1958 | Sparrow | 414/641 X |
| 2,911,111 | 11/1959 | Grove | 212/261 X |
| 3,303,940 | 2/1967 | Valla | 212/261 X |
| 3,633,702 | 1/1972 | Shaw | 212/264 X |
| 3,891,103 | 6/1975 | Harris et al. | 212/261 X |
| 4,394,108 | 7/1983 | Cook et al. | 212/261 X |
| 4,451,193 | 5/1984 | Cannon et al. | 414/563 |
| 4,487,396 | 12/1984 | Hoffman | 414/563 X |
| 4,674,943 | 6/1987 | Nespor | 414/563 |
| 4,790,710 | 12/1988 | Ayalon | 414/563 |

FOREIGN PATENT DOCUMENTS

| | | | |
|---|---|---|---|
| 0565284 | 10/1958 | Canada | 414/560 |
| 0224301 | 7/1985 | German Democratic Rep. | 212/264 |

*Primary Examiner*—Robert J. Spar
*Assistant Examiner*—John Vanden Bosch
*Attorney, Agent, or Firm*—Dority & Manning

[57] ABSTRACT

A mobile crane is disclosed, particularly adapted for a towing truck, as including a boom which may be extended or retracted in length and angularly related for lifting and towing purposes by a pair of hydraulic rams, which are specifically oriented for their full extent of movement at an acute angle relative to the plane of the bed of the truck upon which the hydraulic rams are pivotally secured. Extension and retraction of the boom is provided by a hydraulic ram mounted within the boom and arranged when activated to extend the boom outwardly during the pick up of a load and the retraction prior to towing of the load. The boom is pivotally mounted on a mast structure which is braced against a pivot structure secured to the bed of the truck and to which the hydraulic rams are pivotally mounted. In this arrangement, therefore, the horizontal components of forces produced during the lifting and towing of a load and imposed upon the hydraulic rams is offset by the opposing horizontal components of forces imposed upon the braces by the load.

7 Claims, 7 Drawing Sheets

MOBILE CRANE

BACKGROUND OF THE INVENTION

The present invention relates to crane mechanisms, and more particularly, to crane mechanisms adapted for use on tow trucks and other similar vehicles.

In the prior art, the mobile cranes associated with wrecker trucks for towing other vehicles, or which are utilized for lifting heavy loads from inaccessible places and transporting the same to more appropriate positions for further handling, have employed mechanical winches for lifting the load and other mechanical winches in conjunction with a boom for further positioning of a load. The maximum safe load limit for these mechanical arrangements is generally determined by the mass of the material used in the mechanical devices such as cable diameters, thicknesses of structural steel for the boom and supports therefor, sizes of bolts and pivots, etc.

In these crane designs of the prior art, very little consideration is given to the employment of mechanical advantages to structural parts which would increase the load limits while still staying within all of the safety factors required for wrecker or tow vehicles. For example, the most common wrecker truck, the Holmes 600, has a rather limited maximum load specification for the structure and equipment employed. This particular wrecker truck utilizes hand crank winches to extend and retract a boom and also to adjust its angular orientation during hoisting operations. The boom is anchored for pivotal movement and supported by various bracing members in an arrangement which is not efficient in terms of load capacity and cost for the load to which the arrangement is capable of handling.

The present invention has been devised to overcome the disadvantages pointed out above by (1) utilizing hydraulic rams as the power driven mechanisms for boom manipulation and extension and (2) to arrange the rams, the boom and supporting structure therefor to be more efficient in terms of maximum loads, the capacity for which the invention is capable and involving lower cost for this increased efficiency and load capacity. For example, the mobile crane devised in accordance with the present invention can be considered as a direct replacement for the conventional Holmes 600 wrecker crane, and while this crane has a rated maximum capacity of 16 tons, the present invention associated with the same host vehicle has a rated capacity of 25 tons.

In order to accomplish this efficiency and increase the maximum capacity, the present invention utilizes a hoisting boom having an inner square tube member telescoping within an outer square tube member and a hydraulic ram arranged within the boom members for extending and retracting the inner member.

The boom is pivoted at one end on the flat bed of a host truck utilizing a novel pivoting device for distributing the great forces experienced by the boom along its longitudinal axis more evenly along the truck bed. A pair of hydraulic rams are supported on the flat bed for driving and controlling the angular movements of the boom during hoisting operations, the same being oriented to provide maximum mechanical advantage for these operations thereby effecting maximum efficiency out of these devices for the purposes intended. Each of the rams are served by a hydraulic circuitry which will insure safety with no disturbance to the boom and therefore the load being manipulated in the event of hydraulic failure.

It is the principle object of the present invention to employ hydraulic rams as the power drive mechanism for a mobile wrecker or tow vehicle and thereby increase the maximum load capacity therefor.

Another object of the invention is to increase the efficiency of a mobile crane by arranging the hoisting and moving devices associated with the crane in a manner wherein maximum mechanical advantages may be employed.

These and other objects of the invention will become apparent after reading the following description taken in conjunction with the accompanying drawings.

BRIEF DESCRIPTION OF THE DRAWINGS

FIG. 5 is a cross-sectional view taken along lines 5—5 in FIG. 4;

DETAILED DESCRIPTION OF THE PREFERRED EMBODIMENT

Figure 1:
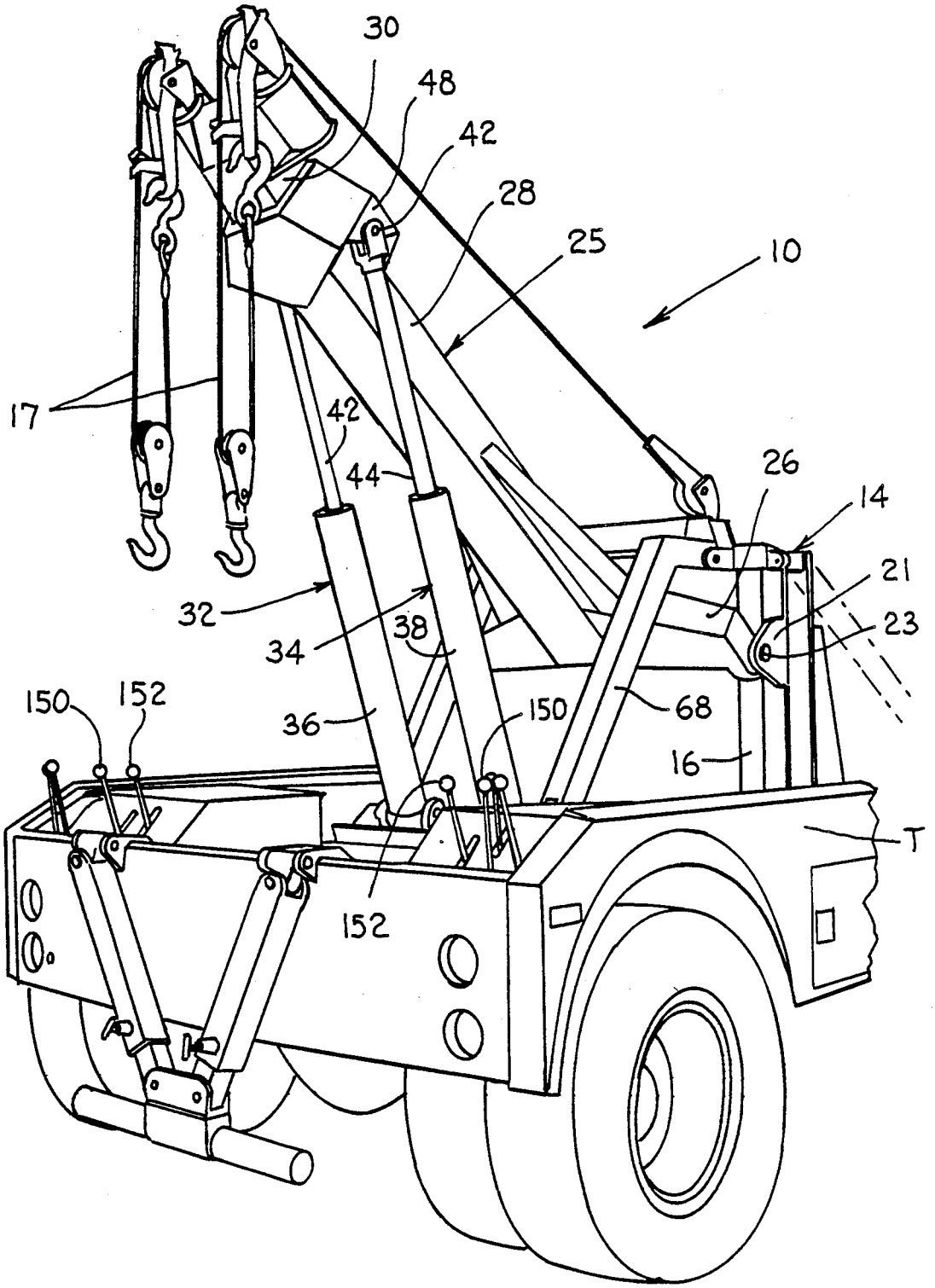
FIG. 1 is an isometric view of the present invention shown as mounted upon a suitable vehicle such as tow truck bed.

In order not to obscure the present invention, the drawings and the following description only include those parts of a vehicle, preferably a conventional towing truck, as are deemed necessary for one skilled in the art to practice the invention. For example, it will be understood by one skilled in the art of mobile cranes such as utilized in towing trucks that a complete vehicle or truck would include a truck cab, motor and transmission system and a horizontally arranged truck bed upon which a crane is mounted for operation.

As shown in FIGS. 1–4, the crane devised and arranged in accordance with the present invention is indicated generally by the reference numeral 10 mounted upon a flat horizontally oriented truck deck 12 for a truck or other vehicle T. Common to all towing trucks, the conventional crane includes a vertically projecting mast structure 14. The mast structure 14 normally comprises two upwardly projecting members 16.

The mast vertical members 16 serve to support the crane boom of the conventional crane and also to support winching mechanism with attendant cables, gear boxes, motor drives, etc. for the complete operation of the crane mechanisms. In the present invention, the conventional winching mechanisms 17 with attendant cables 15, gear boxes 19, etc. are utilized in conjunction with a system of hydraulic rams and a hydraulic system for operating the crane boom in all of its operative positions. In this inventive arrangement, the winching mechanisms 17 and cables 18 are utilized solely for the movement of a load to its final position prior to towing by the host vehicle.

Intermediate the upper and lower ends of each of the vertical mast members 16 is a bracket 20, 21 each supporting a pivot pin 22, 23 respectively. The pivot pins 22, 23 support for limited pivotal movement a boom structure generally indicated by the reference numeral 25. The boom structure 25 comprises a yoke 26 which is directly mounted on the pivot pins 22, 23, and inwardly extending outer boom member 28 and an outwardly extending inner boom member 30 slidably received within the outer member 28 in telescoping fashion.

Pivotal movement of the boom structure 25 is provided by a pair of upwardly projecting boom lifter or elevator hydraulic rams 32, 34 arranged in parallel. Each of the rams 32, 34 includes a cylinder 36, 38, respectively, pivotally mounted upon a pivot structure 40 welded to the truck bed 12 and a piston rod 42, 44. The outer end of the piston rod 42 is pivotally connected by a pivot pin 46 to a bracket 48 secured to the outwardly extending end of the outer boom member 30. Similarly, the outer end of the piston rod 44 of the hydraulic ram 34 is pivotally connected by a pivot pin 56 to the bracket 48.

Figure 2:
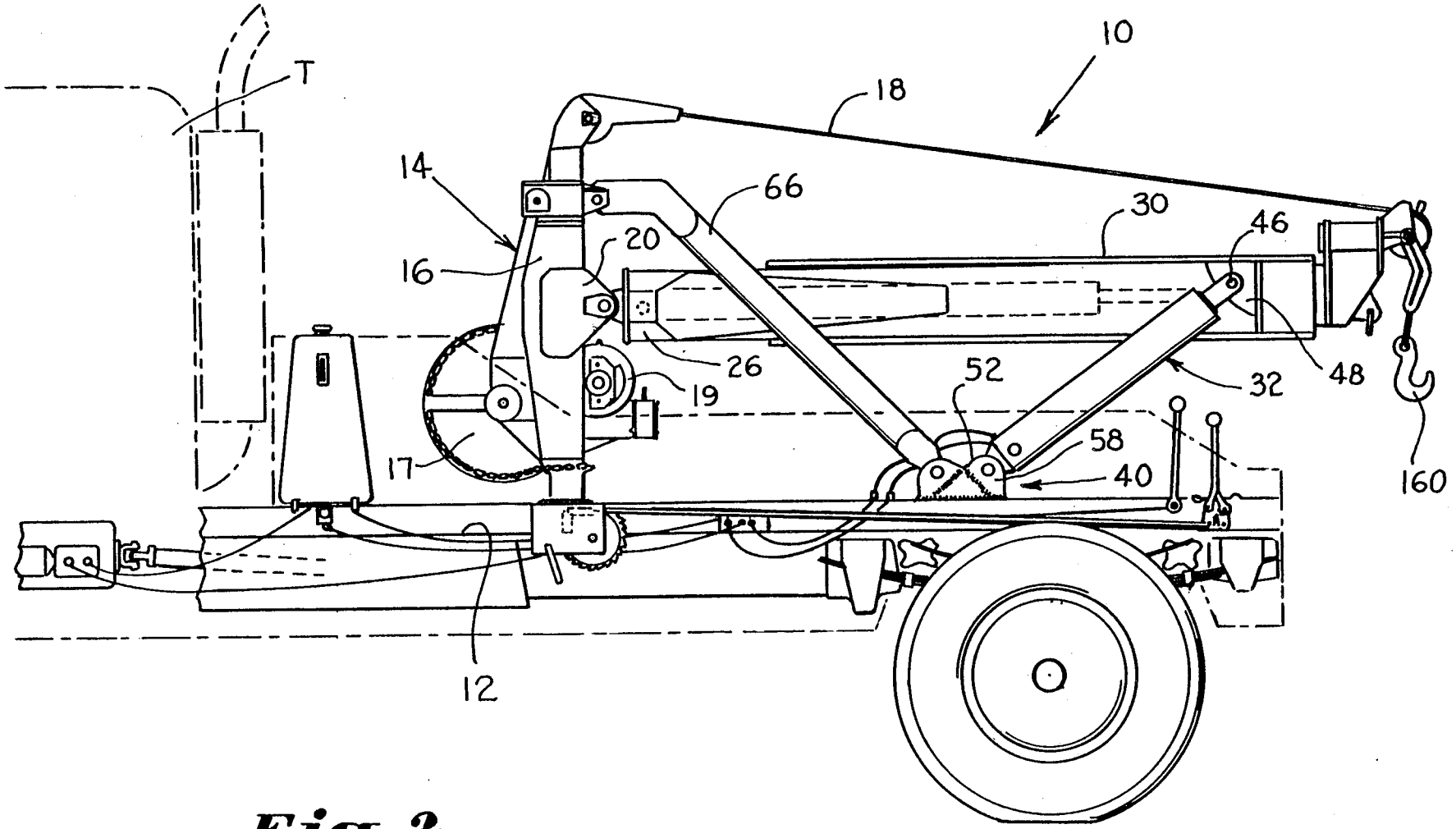
FIG. 2 is an elevational view of the invention shown in one position of operation on the truck bed.
Figure 4:
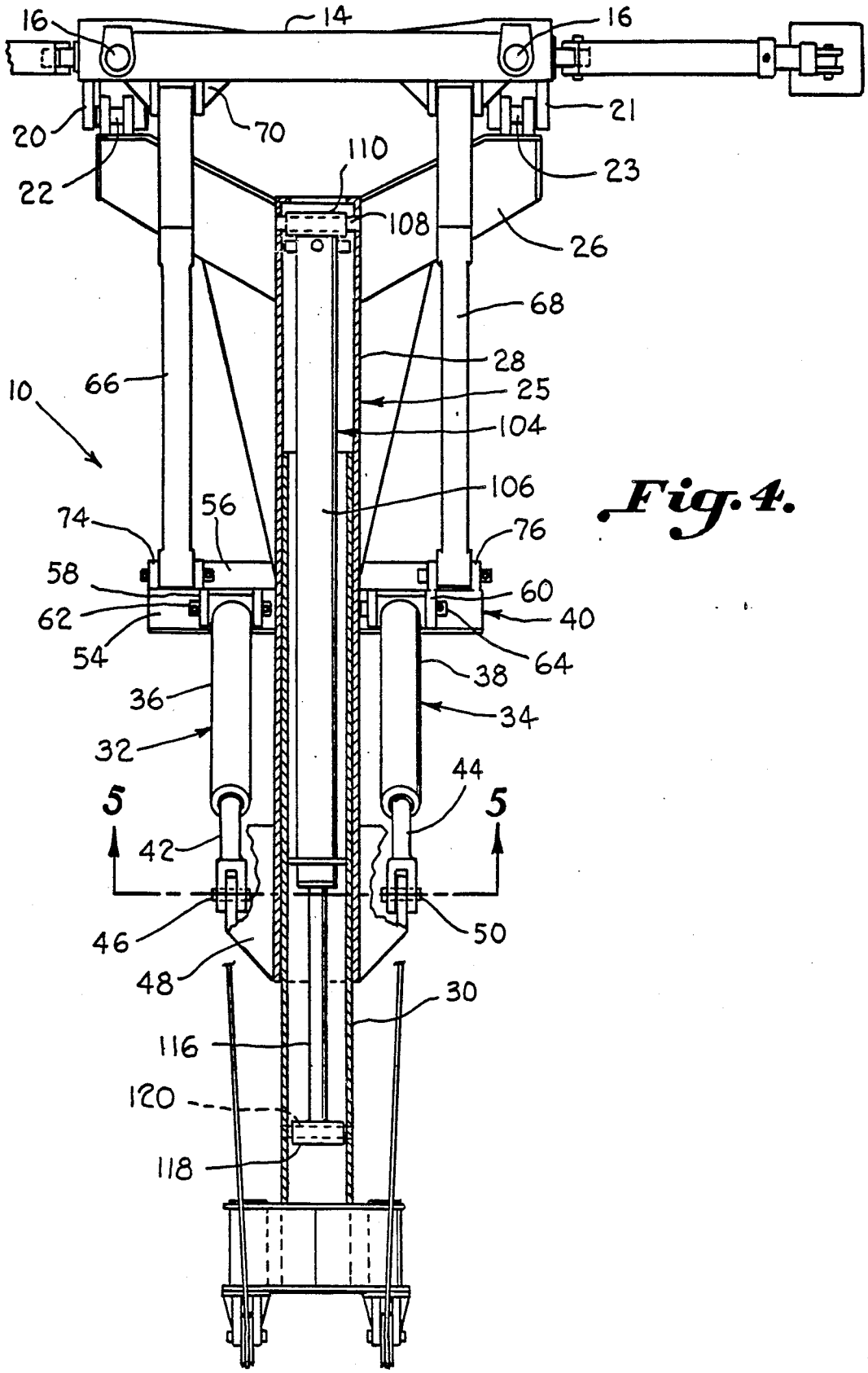
FIG. 4 is a plan view of the crane shown in its extended position.

As shown in FIGS. 2 and 4, the pivot structure 40 comprises an angled member 52 welded to the bed 12 transversely to the axes of the boom structure 25, the member 52 having angled elements 54, 56 upon which are welded U-shaped brackets 58, 60. The cylinder 36 for the ram 32 is pivotally mounted on the bracket 58 by means of a pivot pin 62 while the cylinder 38 for the hydraulic ram 34 is pivotally mounted to the bracket 60 by way of a pivot pin 64.

Vertical support for the mast structure 14 is provided by a pair of parallel arranged an angled braces 66, 68 secured to brackets 70, 72, respectively, attached to the upper end of the vertical members 16. The other or lower end of the brace 66 is secured to a bracket 74 welded to the angled element 56 of the member 52. Similarly, the brace 68 is mounted by way of a bracket 76 to the element 56. The braces 66, 68 serve to maintain the vertical rigidity of the mast structure 14 during the lifting and towing of heavy loads by the crane 10.

It will be noted that the member 52 is arranged generally at the midpoint of the length of the boom 25 when in retracted position. The member 52 generally resembles an angle iron and has its angled elements 54, 56 supporting the longitudinal lines of forces produced by the hydraulic rams 32, 34 and the braces 66, 68. It has been found that this general position of the common support means for the rams and the braces provided optimum distribution of the forces throughout the bed of the truck. By virtue of this arrangement, it will be seen that the horizontal components of forces produced by loads imposed along the longitudinal axes of the rams will generally balance out the oppositely produced horizontal components of forces imposed along the longitudinal axes of the braces 66, 68 during operation of the crane. The effect, then, is that the resultant forces mainly are vertical being taken up solely by the member 52 and its connection with the bed 12. Since the resultant forces are minimized due to the approximate cancellation of the horizontal components of force produced by a load on the rams 32, 34 and braces 66, 68, the structure of the bed 12 below the member 52 need not be as massive as would normally be the case of separate attachments of the rams to the bed 12 different from the connections of the braces 66, 68 to the bed 12.

Figure 6:
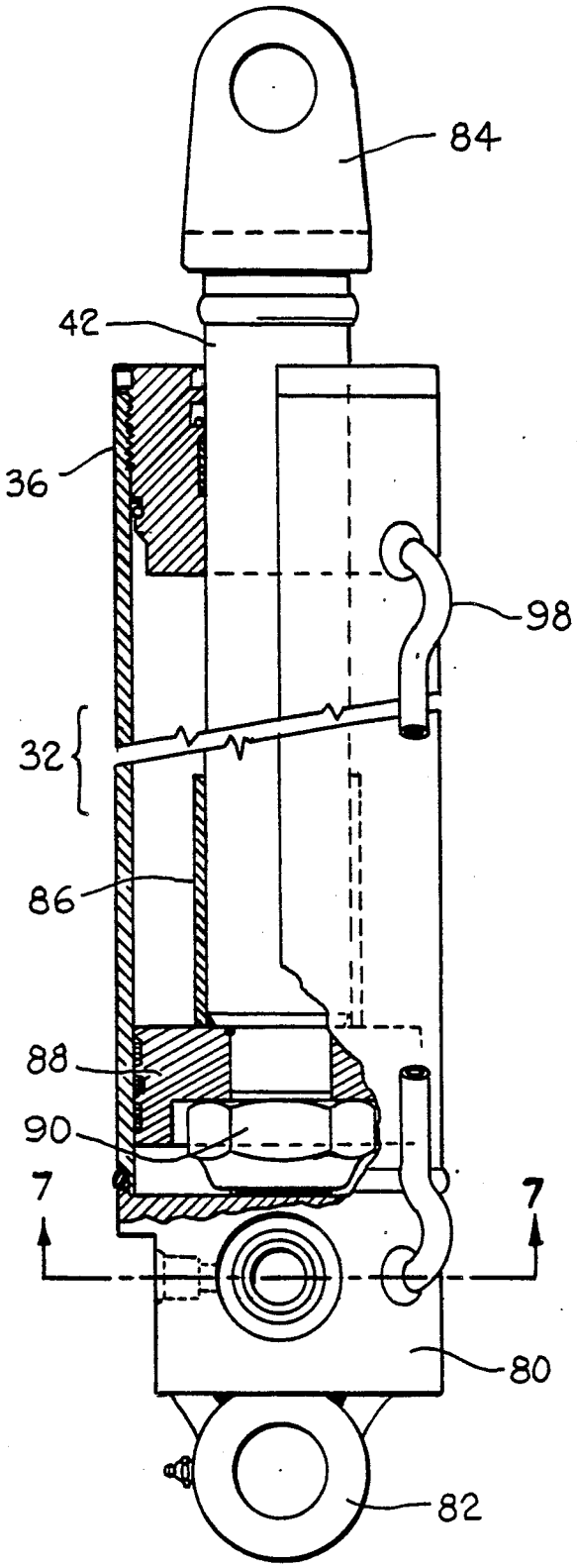
FIG. 6 is a partial view of a hydraulic ram partly in suction.
Figure 7:
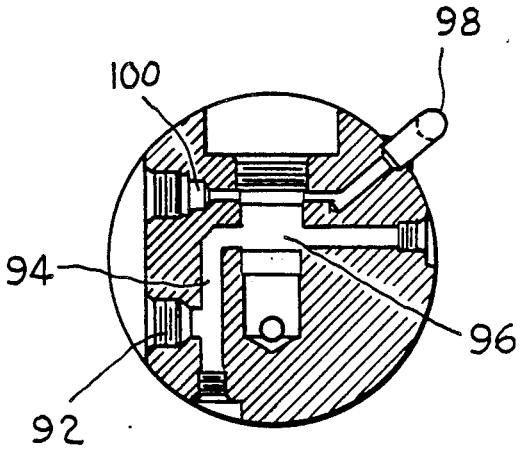
FIG. 7 is a cross-sectional view taken along lines 7—7 of FIG. 6.

One of the boom lifter hydraulic rams 32, 34 is illustrated in FIG. 6 and will be discussed as a single ram since both of these rams are identical. The lower end of the cylinder 36 is formed with a head section 80 to which is secured a bearing member 82 for the pivot pin 62 for securing the ram to the support member 52. The outer end of the piston rod 42 is provided with a yoke 84 for the insertion of the pivot pin 46 for securing the rod to the bracket 48. Within the cylinder 36, a cylindrical spacer 86 is positioned surrounding the rod 42 to limit the extension of the piston rod relative to the cylinder 36. At the other end of piston rod 42, a piston 88 is fixed by means of a threaded element 90.

Fluid is introduced between the head 80 and the piston 88 under pressure through a port 92 formed in the head 80. Fluidized pressure is conveyed to the cylinder by a passageway 94 by way of a check valve 96 retained within the head section 80. Upon movement of the piston upwardly by virtue of the injection of fluid under pressure, fluid within the cylinder behind the piston 88 is exhausted by way of a tube 98 connecting the interior of the upper end of the cylinder to the head 80 and through a passageway to a reservoir for the hydraulic system to be described below.

Figure 3:
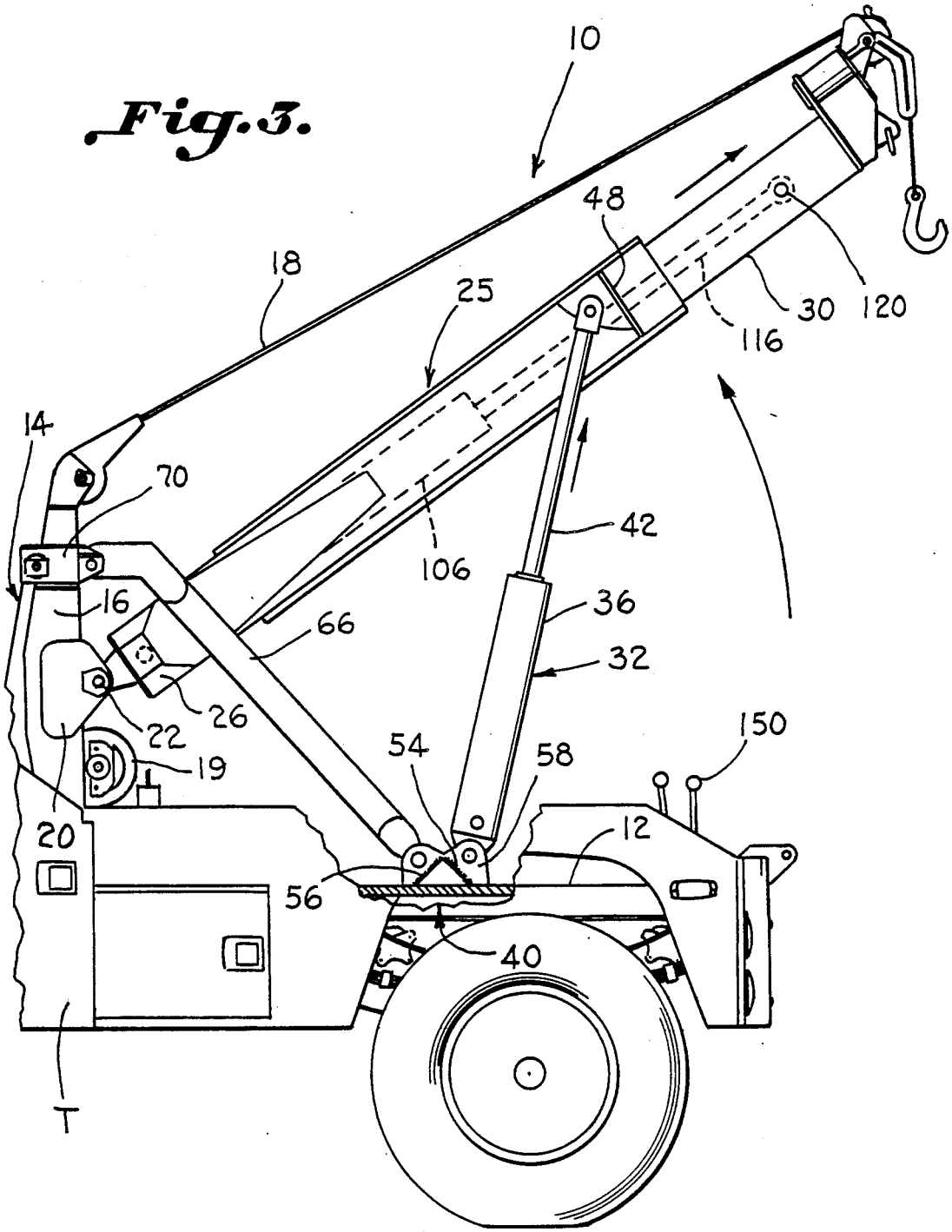
FIG. 3 is partial elevational view of the present invention shown in another position of operation.

Extension and retraction of the inner boom member 30 relative to the outer boom member 28 as shown in FIG. 3 is provided by a hydraulic ram 104 mounted within the boom structure 25. The ram 104 has a cylinder 106 secured by a pivot pin 108 extending through a bearing member 110 secured to the head section 112 of the ram to the sides of the end of the boom member 28. Operable within the cylinder 106 is a piston 114 and a piston rod 116. The extreme outer end of the piston rod 116 is formed with a bearing block 118 detachably attached to the outer end of the outer boom 30 by means of a pin 120.

Figure 8:
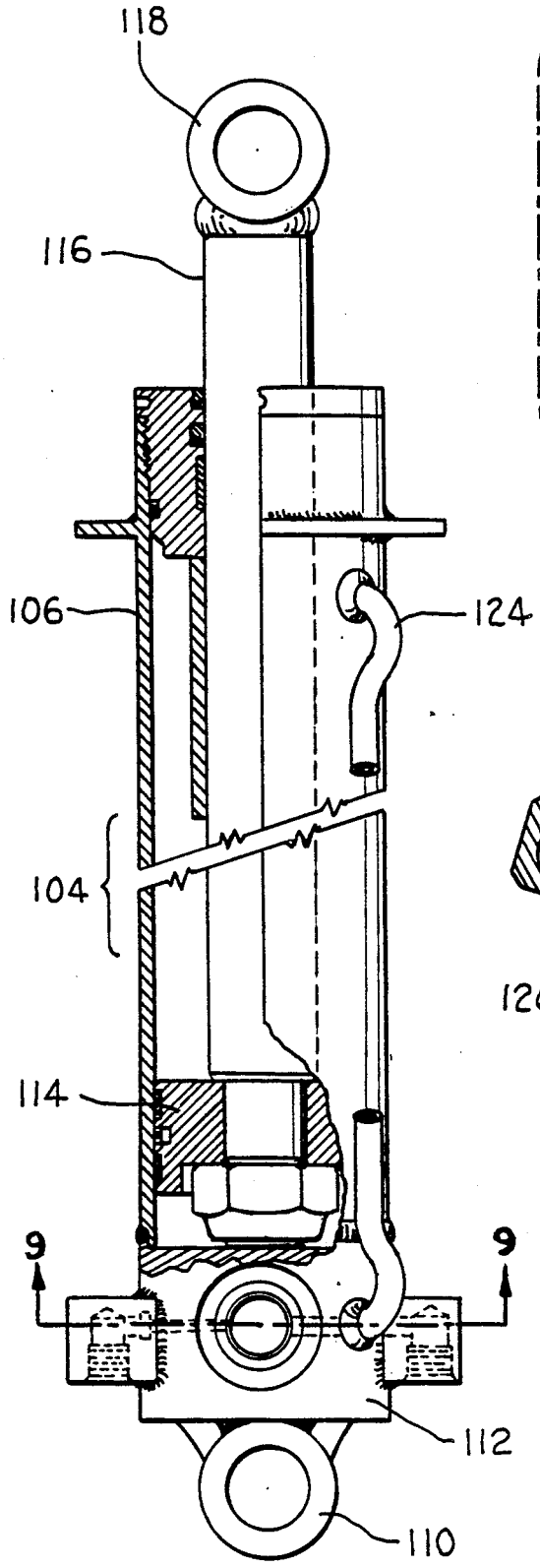
FIG. 8 is a partial view, partly in cross-section, of another hydraulic ram used in the present invention.
Figure 10:
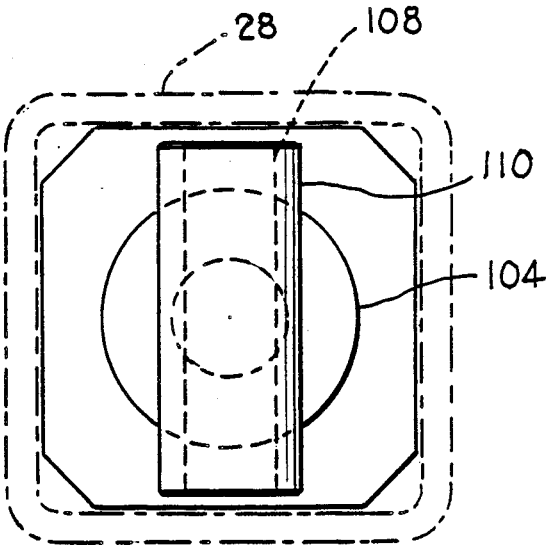
FIG. 10 is a cross-sectional view taken along lines 10—10 in FIG. 8.
Figure 9:
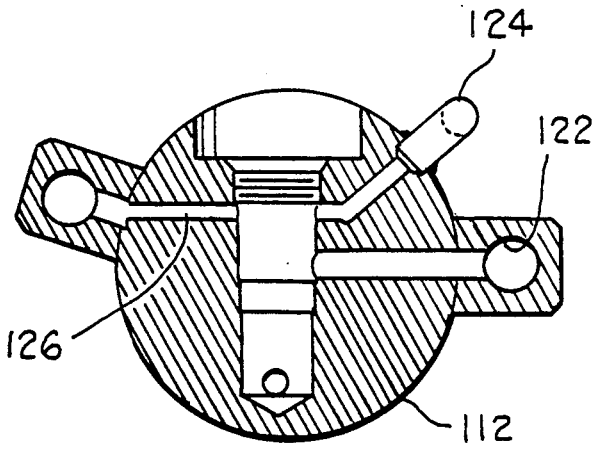
FIG. 9 is a cross-sectional view taken along lines 9—9 in FIG. 8.

As shown in FIG. 8, the head section 112 for the ram 104 is formed with a port 122 for the introduction of hydraulic fluid under pressure to the interior of the cylinder 106 between the piston 112 and the head section. Fluid under pressure being introduced therein extends the rod 116 selectively to extend the outer boom member 30 outwardly from the position shown in FIG. 2 to the figure position shown in FIG. 3 and beyond. As the piston 114 and piston rod 116 are extended, fluid under pressure on the back side of the piston within the cylinder 106 is exhausted out of a tube 124 into the head section 112 and into the reservoir for the hydraulic system by way of a passageway 126 that will be described below.

Figure 11:
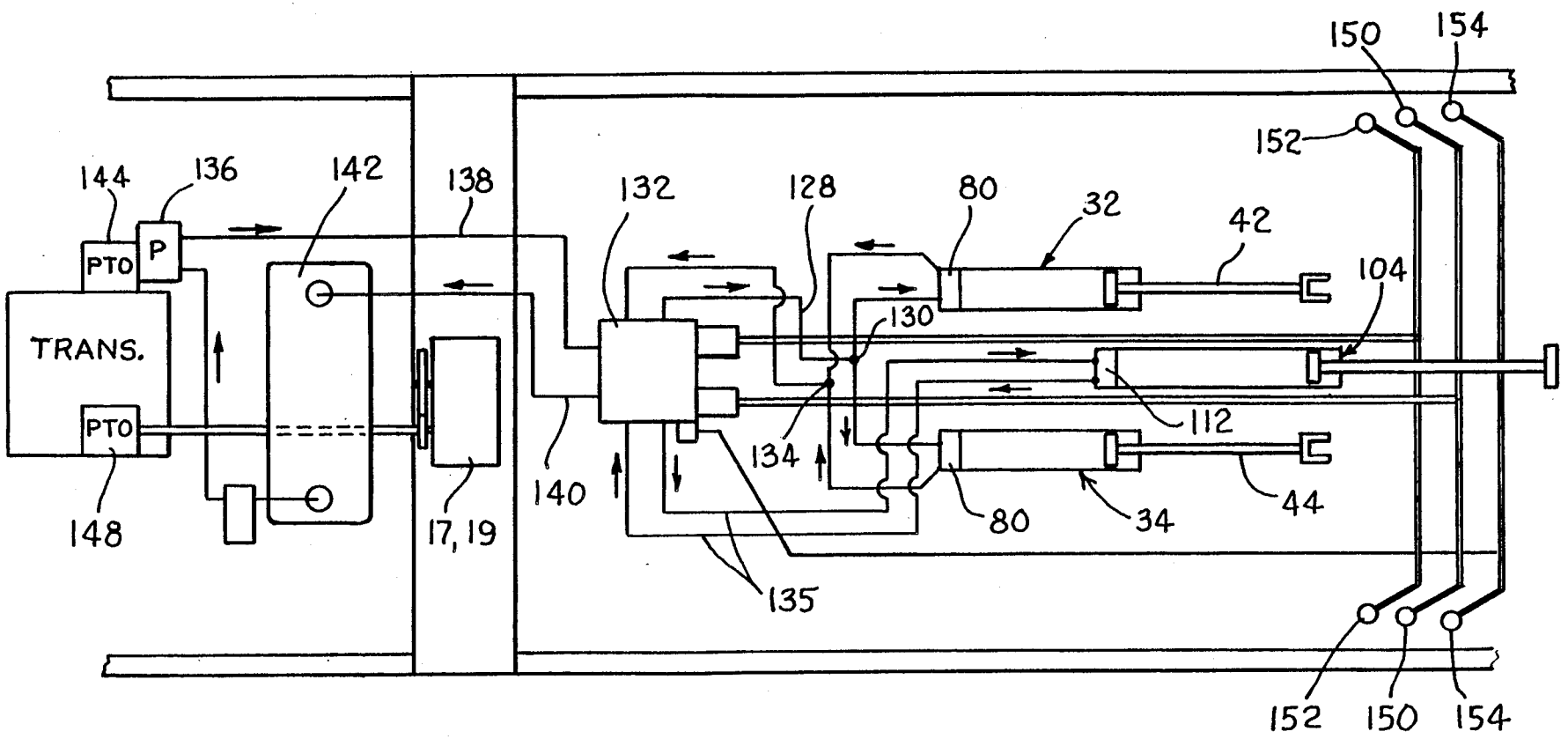
FIG. 11 is a schematic view of the hydraulic system utilized in accordance with the present invention.

In order to retract the piston 114 and thereby retract the boom member 30, the fluid under pressure within the cylinder is exhausted by means of a control valve arrangement. As shown in the hydraulic circuitry of FIG. 11, the heads 80 for the rams 32, 34 respectively, are connected by pressure-inducing tubing 128 and by way of a tee 130, to a valve bank 132. Similarly, the return ports 100, 126 are connected by a tee 134 to the valve bank 132. The head section 112 for the boom extension ram 104 is also connected by tubes 135 to the valve bank 132.

Fluid under pressure is conveyed from a hydraulic pump 136 by way of a tube 138 to the valve bank 132 while fluid is conveyed from the valve bank by way of a return tube 140 to a reservoir 142 for the hydraulic system. Any suitable means may be utilized to operate the hydraulic pump 136 and the more conventional arrangement utilizes a power take-off device 144 mechanically connected to the transmission 146 for the truck T. The same transmission may be also utilized to operate the winch 17 and gear box 19 therefor by means of a power take-off device 148.

Operation of the boom lift rams 32, 34 and the boom extension ram 104 is under control by an operator utilizing pairs of handles 150, 152, 154 which serve to manipulate the valve elements within the valve bank 132. The valve handles are operatively connected to the valve bank electrically, mechanically or hydraulically to operate the same for introducing fluid under pressure to the cylinders 32, 34, 104 for lifting the boom 25, and for extending the inner boom member 30 from their respective positions as shown in FIG. 2 to the positions shown in FIG. 3.

In normal transporting of the crane 10 by the truck T, the boom 25 and rams 32, 34 and 104 are in their positions illustrated in FIG. 3. For lifting and transporting a load, the operator manipulates the controls 150, 152, 154 from either side of the truck to extend the boom 25 and to angularly position the same appropriately for the positioning of the crane hook 160 whereby the load may be applied thereto. Since the operation of the rams 32, 34 is independent from the operation of the ram 104, these manipulations may be made sequentially or concurrently, as determined by best approach for addressing the load and the skill of the operator. After applying the hook to the load, renewed manipulations of the controls as appropriate to the load, its configuration and other circumstances, may be initiated and completed to insure that the extent of boom extension and the angle thereof is best suited for transporting or further handling of the load.

As previously discussed, the boom lifter rams 32, 34 are positioned so that throughout their entire range of angular orientation relative to the full extent or retraction of the boom 25 so that maximum mechanical advantage for these operations are available, thereby making possible the maximum efficiency out of these devices for the purposes intended. These goals are accomplished mainly by the orientation of the rams 32, 34 such that their longitudinal axes for all angular positions will always assume, or rather remain, at an acute angle relative to the plane of the vehicle bed when viewed outwardly of the vehicle. For all angular orientations of the rams will then be such that the horizontal components of force produced by the application of loads will be fully or partially cancelled by the oppositely produced horizontal components of force derived from the braces 66, 68. Another significant advantage of the arrangements described for the boom 25, the rams 32, 34 and the braces 66, 68, resulting from the cancellation or partial cancellation of the horizontal components of forces mentioned above, is that the pivot structure 40 to which the braces and rams are secured may be made from lighter material than would normally be required for other arrangements and angular orientations of these structural devices. On the other hand, because of the orientation described herein, the lifting and towing capacity for the crane may be considerably increased by adding still more structures to the pivot structure 40.

From the foregoing, it will be appreciated that the present invention greatly increases the load capacity of a crane than normally expected or derived from conventional cranes, particularly the common wrecker truck known as the Holmes 600. It will also be appreciated that the load capacity may be increased considerably by the mere increase of structural support, thereby increasing the capability of the crane in the most economical and simplest way.

It will be understood that while the forms of the invention herein shown and described constitute a preferred embodiment of the invention, it is not intended to illustrate all possible forms of the invention. It will also be understood that the words used are words of description rather than of limitation and that various changes may be made without departing from the spirit and scope of the invention herein disclosed.

That which is claimed is:

1. In combination with a towing/hoisting vehicle having a flat bed upon which a winching mechanism is arranged in association with a vertical mast structure for supporting pulleys for cables utilized in hoisting and holding heavy loads, the improvement comprising:

a boom 25 having an inwardly extending member pivotally mounted at one end to the mast structure and an outwardly extending member slidably arranged within said inwardly extending member, said outwardly extending member having one or more pulleys positioned at its outer end for operative cooperation with the cables, a fluid-operable, cylinder/piston extension ram arranged within said boom and having one end connected to the interior of said inwardly extending member and another end connected to the interior of said outwardly extending member whereby activation of said ram produces outward extension of said outwardly extending member and, therefore, said one or more pulleys relative to the mast structure, a pair of fluid-operable, cylinder/piston elevation rams arranged generally in parallel with each having an end connected adjacent to the outer end of said inwardly extending member and another end pivotally secured to an anchor structure on the vehicle bed, said elevation rams, when activated, being adapted to pivot said boom selectively in a range of orientations between minimum and maximum angular positions, said anchor structure being arranged so that for all orientations of said boom, the longitudinal axes of said elevator rams will be at an acute angle relative to the plane of the vehicle bed extended outwardly below said outer member, brace members connected between an upper portion of the mast structure and said anchor position, thereby being arranged to counteract some of the horizontal components of forces upon said elevator rams during lifting of loads, and wherein said anchor structure comprises a member having first and second angled elements angularly related to each other and to the plane of the vehicle bed and wherein said brace members are connected to one of said angled elements and said elevator rams are pivotally connected to the other of said angled elements.

2. The improvement as defined in claim 1, including control means operatively connected to said extension ram for selectively extending and retracting the same and said one or more pulleys.

3. The improvement as defined in claim 1, including control means operatively connected to said elevator rams for selectively pivoting said boom between its operational minimum and maximum angular positions.

4. The improvement as defined in claim 1 wherein said extension ram and said elevator rams include means positioned within the respective cylinders therefor for limiting the maximum extensions thereof.

5. A crane comprising:

a generally vertically oriented mast structure, a boom 25 having an inwardly extending member pivotally mounted at one end to the mast structure and an outwardly extending member slidably arranged within said inwardly extending member, said outwardly extending member having one or more pulleys positioned at its outer end for operative cooperation with the cables, a fluid-operable, cylinder/piston extension ram arranged within said boom and having one end connected to the interior of said inwardly extending member and another end connected to the interior of said outwardly extending member whereby activation of said ram produces outward extension of said outwardly extending member and, therefore, said one or more pulleys relative to the mast structure, a pair of fluid-operable, cylinder/piston elevation rams arranged generally in parallel with each having an end connected adjacent to the outer end of said inwardly extending member and another end pivotally secured to an anchor structure, said elevation rams, when activated, being adapted to pivot said boom selectively in a range of orientations between minimum and maximum angular positions, said anchor structure being arranged so that for all orientations of said boom, the longitudinal axes of said elevator rams will be at an acute angle relative to the horizontal extending outwardly below said outer member, brace members connected between an upper portion of the mast structure and said anchor position, thereby being arranged to counteract some of the horizontal components of forces upon said elevator rams during lifting of loads, and wherein said anchor structure comprises a member having first and second angled elements angularly related to each other and to said anchor structure and wherein said brace members are connected to one of said angled elements and said elevator rams are pivotally connected to the other of said angled elements.

6. The improvement as defined in claim 5, including control means operatively connected to said extension ram for selectively extending and retracting the same and said one or more pulleys.

7. The improvement as defined in claim 5, including control means operatively connected to said elevator rams for selectively pivoting said boom between its operational minimum and maximum angular positions.

* * * * *